United States Patent [19]

Ebihara

[11] Patent Number: 4,717,063

[45] Date of Patent: Jan. 5, 1988

[54] STAPLER ANVIL

[75] Inventor: Yoshiyuki Ebihara, Tokyo, Japan

[73] Assignee: Etona Company, Limited, Tokyo, Japan

[21] Appl. No.: 899,678

[22] Filed: Aug. 25, 1986

[30] Foreign Application Priority Data

Dec. 16, 1985 [JP] Japan ..... 60-280969

[51] Int. Cl.[4] ..... B25C 5/02

[52] U.S. Cl. ..... 227/155; 227/156; 227/120

[58] Field of Search ..... 227/120, 155, 131, 156

[56] References Cited

U.S. PATENT DOCUMENTS 2,181,904 12/1939 Maynard et al. ..... 227/155

4,405,073 9/1983 Escalante ..... 227/156

*Primary Examiner*—E. R. Kazenske

*Assistant Examiner*—James L. Wolfe

*Attorney, Agent, or Firm*—Wood, Dalton, Phillips, Mason & Rowe

[57] ABSTRACT

The present invention provides a stapler including a base, a frame pivotally mounted on the base as its rearward end, a handle pivotally mounted on the frame at its rearward end, at least the handle being made of a plastic material, the base including a recess formed on its surface facing the frame at the forward end, and a metallic anvil element being pressed into the recess on the base, the anvil element having at least one pointed projection extending outwardly from the side wall of the anvil element, the pointed projection biting into the material of the base at the corresponding side wall of the recess to hold the anvil element within the recess.

3 Claims, 3 Drawing Figures

STAPLER ANVIL

BACKGROUND OF THE INVENTION

1. Field of the Invention:

The present invention relates to a stapler and more particularly to an anvil on the base of the stapler at its forward end.

2. Description of the Prior Art:

There is known a stapler comprising a base, a frame pivotally mounted on the base at its rearward end and a handle pivotally mounted on the frame at its rearward end. The inventors have proposed various types of such staplers. Among them, a stapler is very advantageous in manufacturing and economy which all the parts thereof are made of plastic material except an actuating member of steel for driving staples and an anvil of steel for receiving and deforming the driven one of the staples. In such a stapler, the anvil is made of a resilient metal sheet and pressed into a recess formed on the base at its forward end. The anvil is held in the recess under frictional engagement of its side faces with the side walls of the recess. Such an anvil construction should be improved in rigidity and durability.

SUMMARY OF THE INVENTION

It is an object of the present invention to provide a stapler of the above type in which a metallic anvil is pressed into a recess formed on the plastic base at its forward end and includes at least one pointed projection extending outwardly from the side fase of the anvil. When mounted, the pointed projection of the anvil bites into the material of the base at the corresponding side wall of the recess to hold the anvil in the recess.

DESCRIPTION OF PREFERRED EMBODIMENT

The present invention will now be described in details with reference to the accompanying drawings. The construction of an illustrated stapler is similar to a cassette type stapler which has been proposed by the inventors. However, it will be apparent for those skilled in the art that the present invention can similarly be applied to the other types of staplers.

Figure 1:
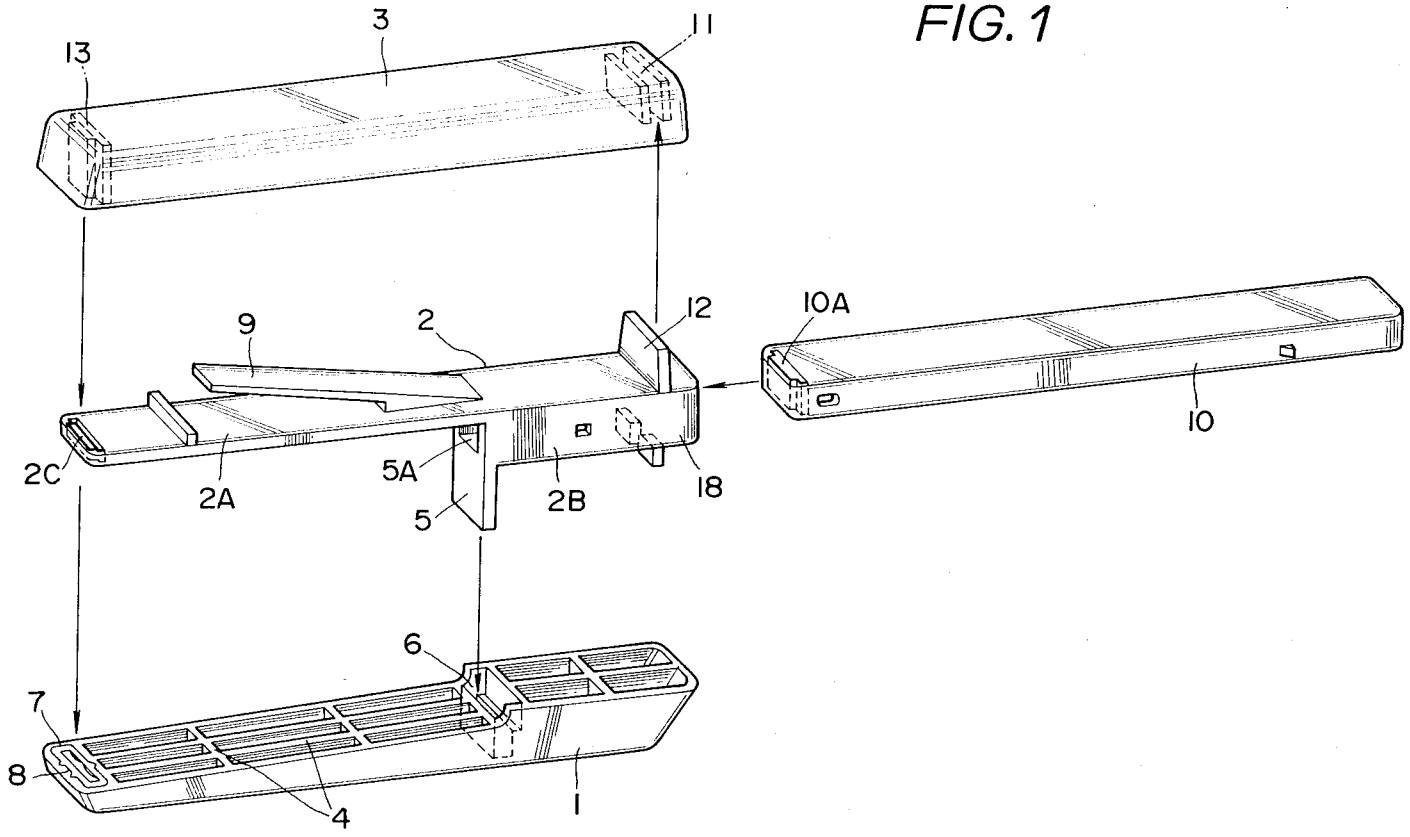
FIG. 1 is an exploded perspective view of a stapler incorporating one embodiment of an anvil element constructed in accordance with the present invention.
Figure 2:
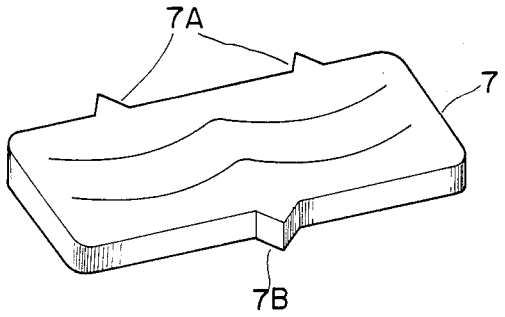
FIG. 2 is a perspective and enlarged view of the anvil element shown in FIG. 1.
Figure 3:
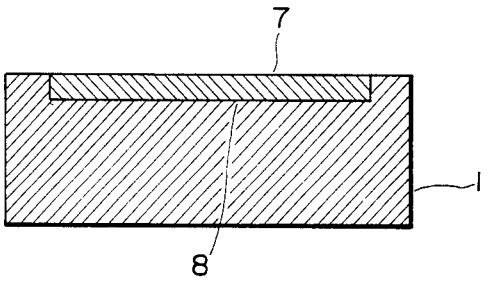
FIG. 3 is a cross-sectional view of the stapler in a section passing through the anvil element.

Referring now to FIG. 1, there is shown a stapler comprising a base 1, a frame 2 pivotally mounted on the base 1 in such a manner as will be described, and a handle 3 pivotally mounted on the frame 2 in such a manner as will be described. All of these parts are made of a plastic material.

The base 1 is in the form of an elongated box which is provided with inner reinforcing partitions 4 and a recess 6 formed in the base 1 at a location offset from its center slightly to the rearward direction. The purpose of this recess 6 will be apparent in the process of description.

The frame 2 is used also as a cassette holder which will be apparent below and comprises a forward portion 2A which is in the form of an elongated plate, and a rearward portion 2B connected integrally with the forward portion 2A and including a downwardly extending box-shaped part 18. A leaf spring 9 extends forwardly and upwardly from the top face of the frame 2. The leaf spring 9 co-operates with the handle 3 as will be apparent below. The box-shaped part 18 of the rearward portion 2B includes a resilient lug 5 downwardly extending from the box-shaped part 18 at its forward end. On assembling, the resilient lug 5 is fitted into the recess 6 of the base 1 such that the frame 2 can be pivoted about the resilient lug 5. The box-shaped part 18 of the frame 2 also includes an opening 5A of a rectangular cross-section extending longitudinally therethrough. The opening 5A is adapted to receive a cassette 10 in which staplers has been precharged.

The handle 3 is in the form of an elongated box similar to the base 1 and includes an actuating member 13 which is located within the handle body at its forward end. As well known, the actuating member 13 is moved through a forward end opening 2C of the frame 2 and a forward end opening 10A of the cassette 10 when the handle 3 is pivoted with the forward end moving toward the frame and base 2, 1. At this time, the forwardmost one of the staples within the cassette 10 is driven downwardly toward an metallic anvil 7 on the base 1 whereat the driven staple is deformed to bind objects such as sheets of paper.

The handle 3 also includes a gap 11 formed therein at the rearward end and which is adapted to receive a resilient lug 12 upwardly extending from the top of the frame 2 at its rearward end. Thus, the handle 3 can resiliently pivoted about the lug 12 toward the frame 2 and thus the base 1.

In accordance with the present invention, the base 1 includes a shallow recess 8 formed on the surface facing the frame 2 and thus the handle 3 at the forward end of the base 1. The anvil 7 is pressed into this recess 8. In the illustrated embodiment, the anvil 7 includes two pointed projections 7A extending forwardly from the forward side wall thereof and a pointed projection 7B extending rearwardly from the rearward side wall of the anvil 7. When the metallic anvil 7 is pressed into the recess 8, the pointed projections 7A and 7B bite into the material of the base 1 at the corresponding side walls thereof. Thus, the anvil 7 can firmly be held within the recess 8. It is preferred that the anvil 7 is made of a metal sheet having a relatively large thickness to increase the bite of the pointed projections 7A and 7B into the material of the base 1. In such a manner, the rigidity and durability of the anvil 7 can be increased to firmly receive a staple driven by the actuating member 13.

The number of position of the projections on the anvil 7 may optionally be selected within the scope of the invention.

I claim:

1. A stapler comprising a base, a frame, and a handle with each having a forward end portion, an intermediate portion and a rearward end portion, the frame being pivotally mounted on said base at substantially the intermediate portion of said base, the handle being pivotally mounted on said frame at the rearward end portion thereof, at least said base being made of a plastic material, said base having a surface facing said frame at the forward end portion thereof, said base having a recess formed in said surface, said recess being defined by plural walls, and a metallic anvil element being pressed into said recess on said base, said anvil element having at least one side wall and having at least one pointed projection extending outwardly from said side wall of said anvil element, said pointed projection biting into the material of said base at a corresponding side wall of said recess to hold said anvil element within said recess.

2. A stapler as defined in claim 1 wherein said anvil element has a relatively large thickness.

3. A stapler as defined in claim 1 wherein said anvil element has two pointed projections extending forwardly from a forward side wall of said anvil element and a pointed projection extending rearwardly from an opposite side wall of said anvil element.

* * * * *